US007063411B2

(12) United States Patent
Shyu et al.

(10) Patent No.: US 7,063,411 B2
(45) Date of Patent: Jun. 20, 2006

(54) INKJET CARTRIDGE

(75) Inventors: Der-Rong Shyu, Puzih (TW); Ming-Chung Peng, Hsinchu (TW); Yuh-Ming Hsieh, Taoyuan (TW); Chih-ching Chen, Taipei (TW)

(73) Assignee: BENQ Corporation, Taoyuan (TW)

( * ) Notice: Subject to any disclaimer, the term of this patent is extended or adjusted under 35 U.S.C. 154(b) by 231 days.

(21) Appl. No.: 10/792,301

(22) Filed: Mar. 3, 2004

(65) Prior Publication Data

US 2004/0201653 A1 Oct. 14, 2004

(30) Foreign Application Priority Data

Apr. 9, 2003 (TW) ..... 92108096 A

(51) Int. Cl.
*B41J 2/175* (2006.01)

(52) U.S. Cl. ..... 347/87

(58) Field of Classification Search ..... 347/20, 347/65, 86, 87, 43
See application file for complete search history.

(56) References Cited

U.S. PATENT DOCUMENTS 5,119,115 A * 6/1992 Buat et al. ..... 347/86
5,497,178 A * 3/1996 DeFosse et al. ..... 347/87
5,497,198 A 3/1996 Kim
5,576,750 A 11/1996 Brandon et al.
5,831,653 A 11/1998 Brandon et al.
5,926,195 A * 7/1999 Domhoff et al. ..... 347/87
6,260,961 B1 7/2001 Seu et al.
6,527,382 B1 * 3/2003 Hou et al. ..... 347/87
6,840,609 B1 * 1/2005 Lo et al. ..... 347/86
6,893,120 B1 * 5/2005 Bailey et al. ..... 347/87

* cited by examiner

*Primary Examiner*—Anh T. N. Vo

(74) *Attorney, Agent, or Firm*—Quintero Law Office

(57) ABSTRACT

An inkjet cartridge. The inkjet cartridge includes a body and a seal member. The body includes a first chamber, a second chamber, a third chamber, a first exit, a second exit, a third exit, an opening, and a channel. Ink is received in the first chamber, the second chamber, and the third chamber. The second and third chambers communicate with the second and third exits so that the ink in the second and third chambers flows directly to the second and third exits. The channel communicates the first chamber and the first exit so that the ink in the first chamber flows to the first exit via the channel. The seal member is disposed on the channel via the opening, and seals the channel to prevent ink in the first chamber flowing through the first exit from flowing out of the opening.

33 Claims, 10 Drawing Sheets

INKJET CARTRIDGE

BACKGROUND OF THE INVENTION

1. Field of the Invention

The invention relates to an inkjet cartridge and a basic inkjet cartridge structure with a plurality of partitions. In particular, the invention relates to an inkjet cartridge with simplified process preventing intermixture of ink.

2. Description of the Related Art

The dramatic development of inkjet printing technology has yielded many advantages, including low cost and noiseless operation. The printing quality provided by inkjet printing technology is adequate for full-color printing. Additionally, inkjet printing is suitable for a variety mediums including plain paper, special printing paper, film, and transparencies. Moreover, inkjet printing is a non-contact method that dispenses droplets of ink onto a medium.

Inkjet cartridges can be substantially divided into three types. The first type is a printer with an integrally formed print head and a separable inkjet cartridge, such as Epson. The second one is a printer with a separable print head and a separable inkjet cartridge, such as Canon. The third one is a printer with an inkjet cartridge combined with a print head, such as HP and Lexmark. Regardless of the type of inkjet cartridge, the ink is stored in a chamber, and flows into the print head via the channel to be dispensed.

A conventional inkjet cartridge 100 is disclosed in U.S. Pat. No. 5,831,653. FIG. 1*a* is a perspective view of the inkjet cartridge 100, FIG. 1*b* is a perspective view of a bottom portion of the inkjet cartridge 100, and FIG. 1*c* is a detailed perspective view, of a partial section of the inkjet cartridge 100.

Referring to FIG. 1*a* and FIG. 1*b*, the inkjet cartridge 100 includes three chambers 110, 120, and 130. The ink in the chamber 110 flows out of an exit 112 via a channel 111 in the direction indicated by arrow a1. The ink in the chamber 130 flows out of an exit 132 via a channel 131 in the direction indicated by arrow a3. The chamber 120 and an exit 121 are overlapping, and the ink in the chamber 120 can flow directly out of exit 121 in the direction indicated by arrow a2.

Since the ink in chambers 110, and 130 flows out of exits 112, and 132 via different channels 111, and 131, two openings 140 are formed on both sides of the inkjet cartridge 100 as shown in FIG. 1*a*. During assembly of the inkjet cartridge 100, two plugs 150 are disposed in the openings 140 to prevent the ink from flowing into the surrounding area via the openings 140 as shown in FIG. 1*c*.

Using plugs to seal the openings at both sides during assembly, however, complicates the assembly process. Additionally, a similar structure is also disclosed in U.S. Pat. Nos. 5,497,198 and U.S. Pat. No. 5,576,750.

FIG. 2 shows another conventional inkjet cartridge 200 as disclosed in U.S. Pat. No. 6,260,961 B1. By changing the arrangement of chambers 210, 220, and 230, the channel openings 241, and 242 can be formed on the same side during manufacturing. During assembly, the openings 241, 242 can be sealed by one plug 250.

The openings of different channels are however, sealed by the same plug, and may result in the intermixture of the ink in different chambers when errors occur during manufacturing.

SUMMARY OF THE INVENTION

In view of this, the invention provides an inkjet cartridge with simplified process preventing the intermixture of ink.

Specifically, in the inkjet cartridge of the invention, different kinds of ink flow through different passages. Additionally, when the body of the inkjet cartridge is integrally formed by injection molding, an opening, located in a sidewall of the body, is sealed by a member. Furthermore, to prevent intermixture of different inks due to errors in the manufacturing process, only a single opening, sealed by single member is provided. Thus, the assembly process is simplified, and the printing quality of the inkjet cartridge can be maintained. As a result, inkjet cartridge yield can be increased.

Accordingly, the invention provides an inkjet cartridge including a body and a seal member. The body includes a first chamber, a second chamber, a third chamber, a first exit, a second exit, a third exit, an opening, and a channel. Ink is received in the first chamber, the second chamber, and the third chamber respectively. The second chamber communicates with the second exit so that the ink in the second chamber flows directly to the second exit. The third chamber communicates with the third exit so that the ink in the third chamber flows directly to the third exit. The channel communicates the first chamber and the first exit so that the ink in the first chamber flows to the first exit via the channel. The seal member is disposed on the channel via the opening, sealing the channel to prevent ink in the first chamber flowing through the first exit from flowing out of the opening.

In a preferred embodiment, the inkjet cartridge further includes a chip and a first divider plate. The chip includes a first hole, a second hole, and a third hole. The chip is disposed on the body in a manner such that the first hole, the second hole, and the third hole correspond to the first exit, the second exit, and the third exit respectively. The first hole is located between the second hole and the third hole. The second hole and the second exit are overlapping, and the third hole and the third exit are overlapping. The first divider plate separates the first chamber and the second chamber. The first hole, the second hole, the third hole are aligned in a straight line, and the straight line is substantially parallel with the first divider plate.

In another preferred embodiment, the third hole is located between the first hole and the second hole. The second hole and the second exit are overlapping, and the third hole and the third exit are overlapping. The inkjet cartridge further includes a second divider plate and a third divider plate. The second divider plate separates the second chamber and the third chamber, and the third divider plate separates the first chamber and the second chamber. The first hole, the second hole, the third hole are aligned in a straight line, and the straight line is substantially parallel with the second divider plate. The first hole is closer to the third divider plate than the second hole.

In another preferred embodiment, the seal member is made of the same material as the body. The hardness of a portion, adjacent to the opening, of the body is lower than the other portion of the body.

In another preferred embodiment, the seal member includes a bottom portion and an extended portion. The bottom portion is disposed on the opening, and seals the opening. The extended portion extends in the channel and corresponds to the shape of the channel so that the ink in the first chamber flows smoothly in the channel. The first chamber includes a through hole abutted by the extended portion of the seal member.

In the invention, a structure, for an inkjet cartridge with a plurality of partitions, includes an integrally formed body. The body includes a first chamber, a second chamber, a third chamber, a first exit, a second exit, a third exit, an opening, and a channel. Ink is received in the first chamber, the second chamber, and the third chamber respectively. The second chamber communicates with the second exit so that the ink in the second chamber flows directly to the second exit. The third chamber communicates with the third exit so that the ink in the third chamber flows directly to the third exit. The channel communicates the first chamber and the first exit so that the ink in the first chamber flows to the first exit via the channel. The body and the channel are a single member.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

First embodiment

Figure 1A:
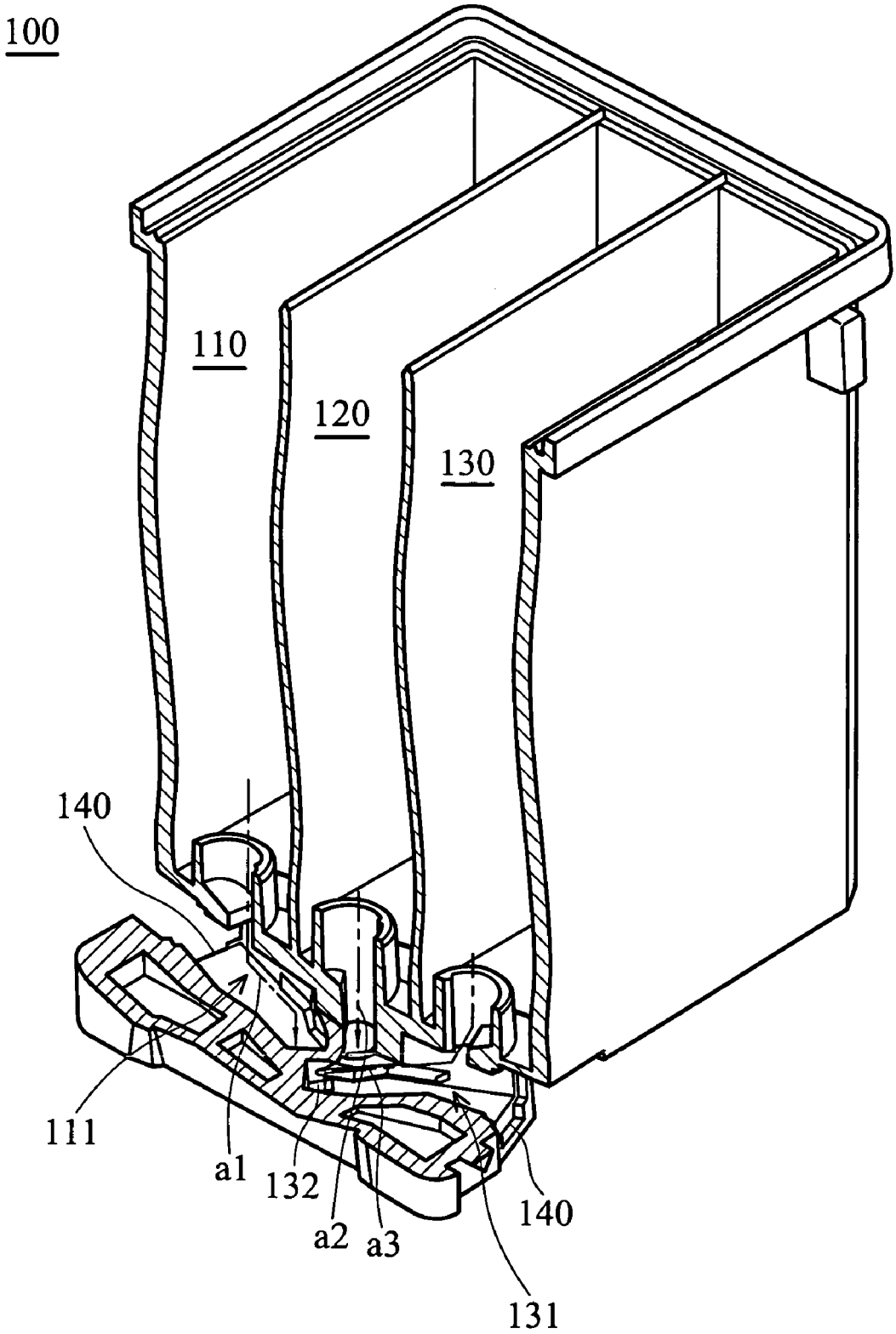
FIG. 1a (RELATED ART)
FIG. 1*a* is a perspective view of a conventional inkjet cartridge as disclosed in U.S. Pat. No. 5,831,653.
Figure 1B:
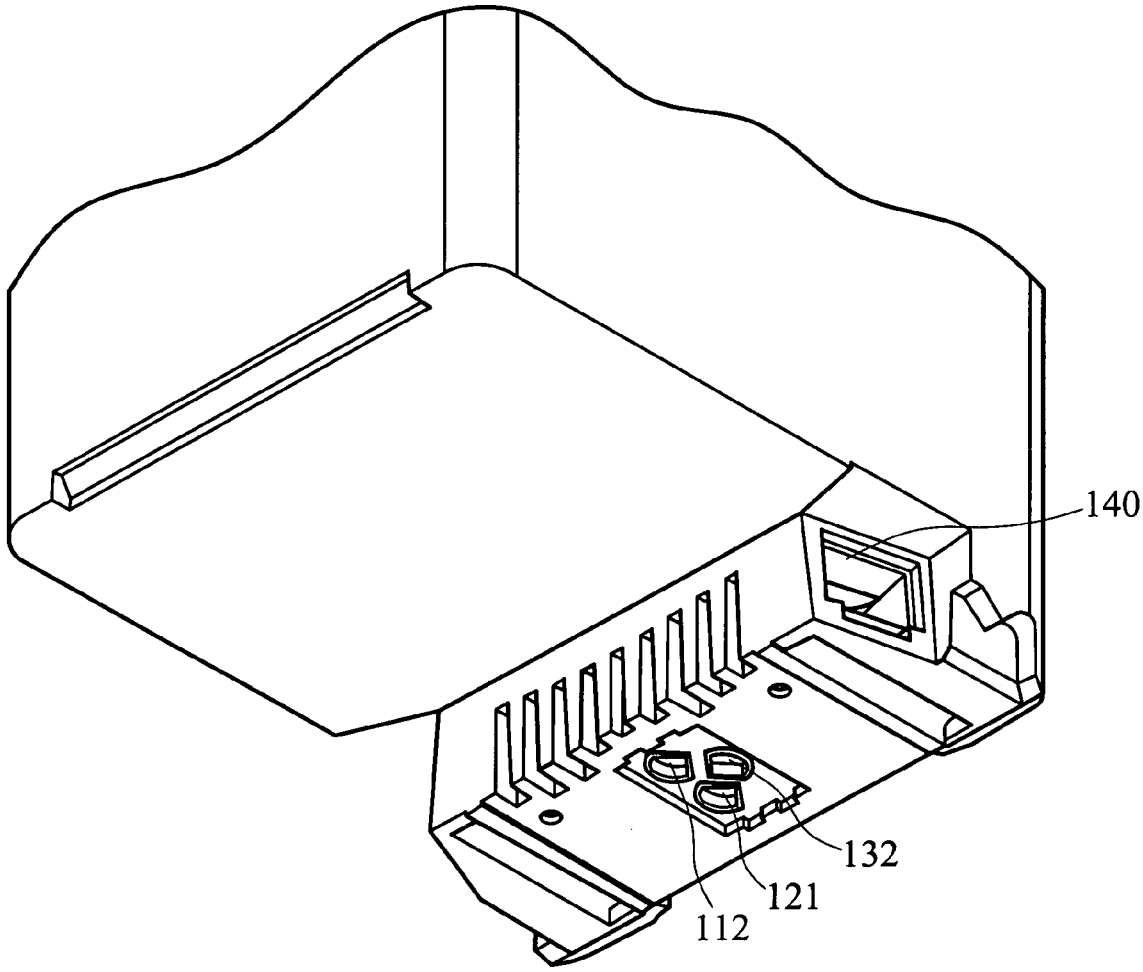
FIG. 1b (RELATED ART)
FIG. 1*b* is a perspective view of a bottom portion of the inkjet cartridge in FIG. 1*a;*
Figure 1C:
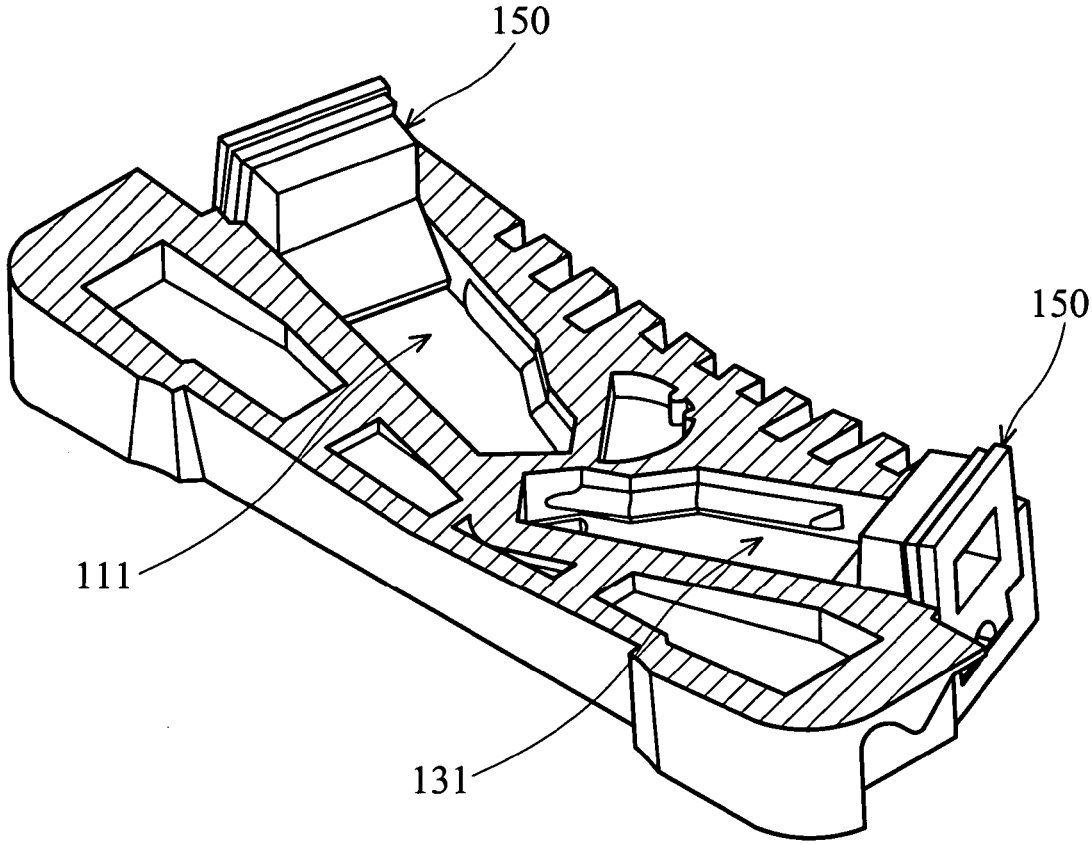
FIG. 1c (RELATED ART)
FIG. 1*c* is a detailed perspective view of a partial section of the inkjet cartridge shown in FIG. 1*a;*
Figure 2:
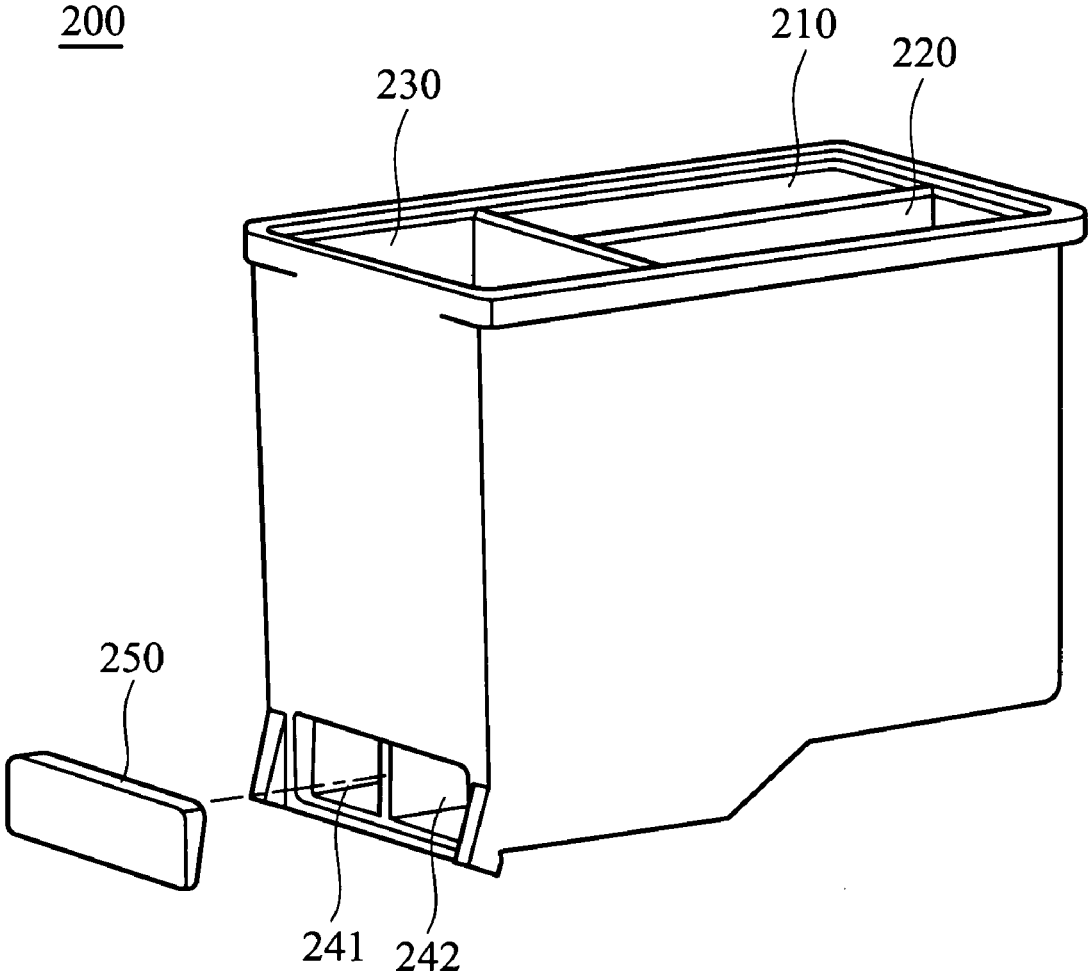
FIG. 2 (RELATED ART)
FIG. 2 is a perspective view of a conventional inkjet cartridge as disclosed in U.S. Pat. No. 6,360,961 B1.

FIGS. 3*a*–3*d* are schematic views of an inkjet cartridge 300 as disclosed in a first embodiment of the invention. The inkjet cartridge 300 dispenses ink I, and includes a body 310, a seal member 320, a chip 330, and a cover 340. The body 310 and the seal member 320 constitute a basic structure 700 of the inkjet cartridge of this embodiment.

The body 310 is a container, and receives ink I through its outer walls. The interior of the body 310 is divided by inner walls into a first chamber 311, a second chamber 312, and a third chamber 313. Different kinds of ink are received in the first chamber 311, the second chamber 312, and the third chamber 313 respectively. The second chamber 312 is located between the first chamber 311 and the third chamber 313. That is, the first chamber 311, the second chamber 312, and the third chamber 313 are juxtaposed in the body 310.

The first chamber 311, the second chamber 312, and the third chamber 313 include a first inlet 311*b*, a second inlet 312*b*, and a third inlet 313*b* at their top surfaces respectively. Ink flows into the first chamber 311, the second chamber 312, and the third chamber 313 through the first inlet 311*b*, the second inlet 312*b*, and the third inlet 313*b* respectively.

The body 310 includes first exit 314, second exit 315, and third exit 316 in the bottom surface, and an opening 318 formed in the side. A channel 317 is formed in the body 310. The first exit 314 is located between the second exit 315 and the third exit 316.

Figure 3A:
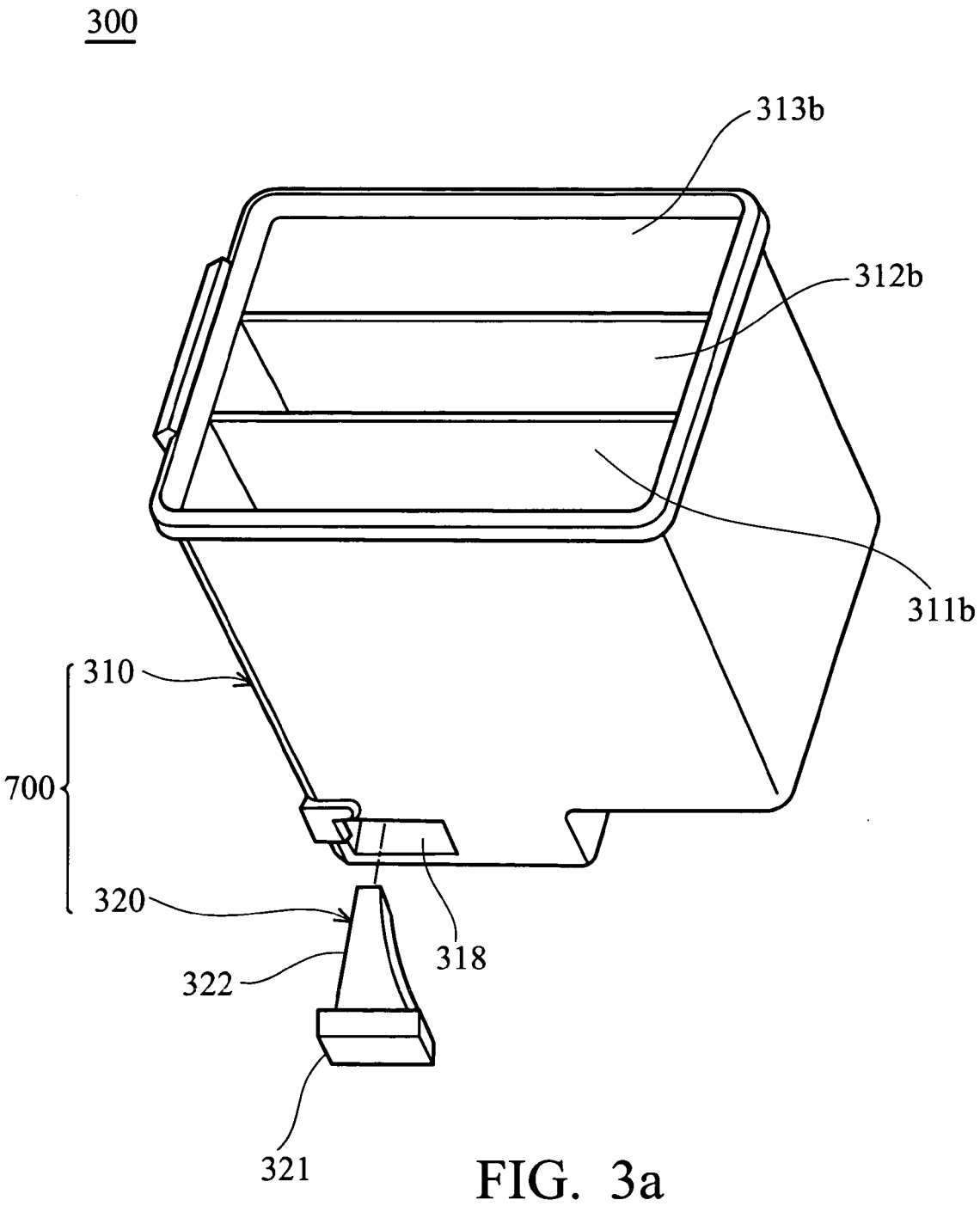
FIG. 3*a* is a schematic view of an inkjet cartridge as disclosed in a first embodiment of the invention.
Figure 3B:
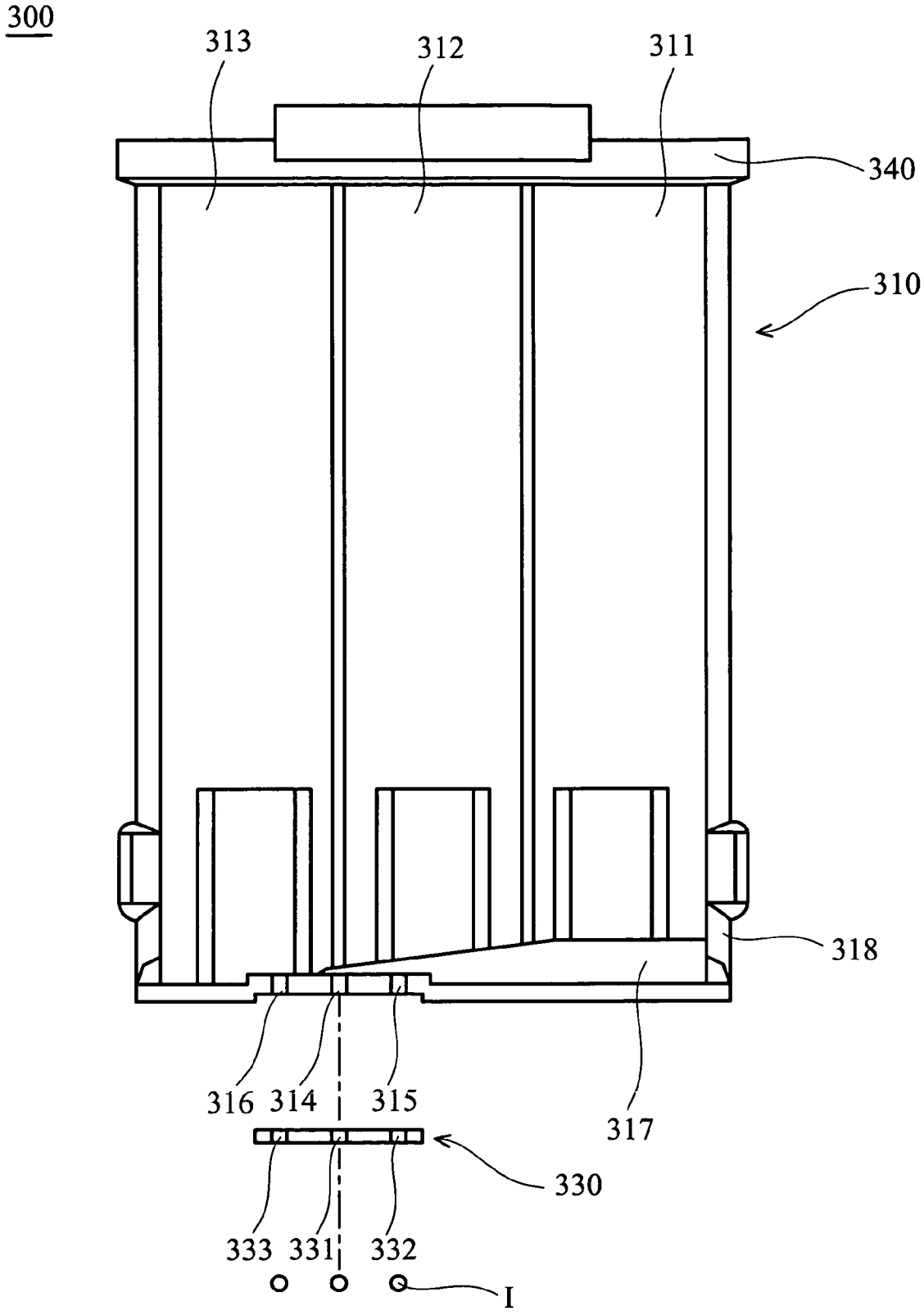
FIG. 3*b* is a cross section of the inkjet cartridge in FIG. 3*a;*
Figure 3C:
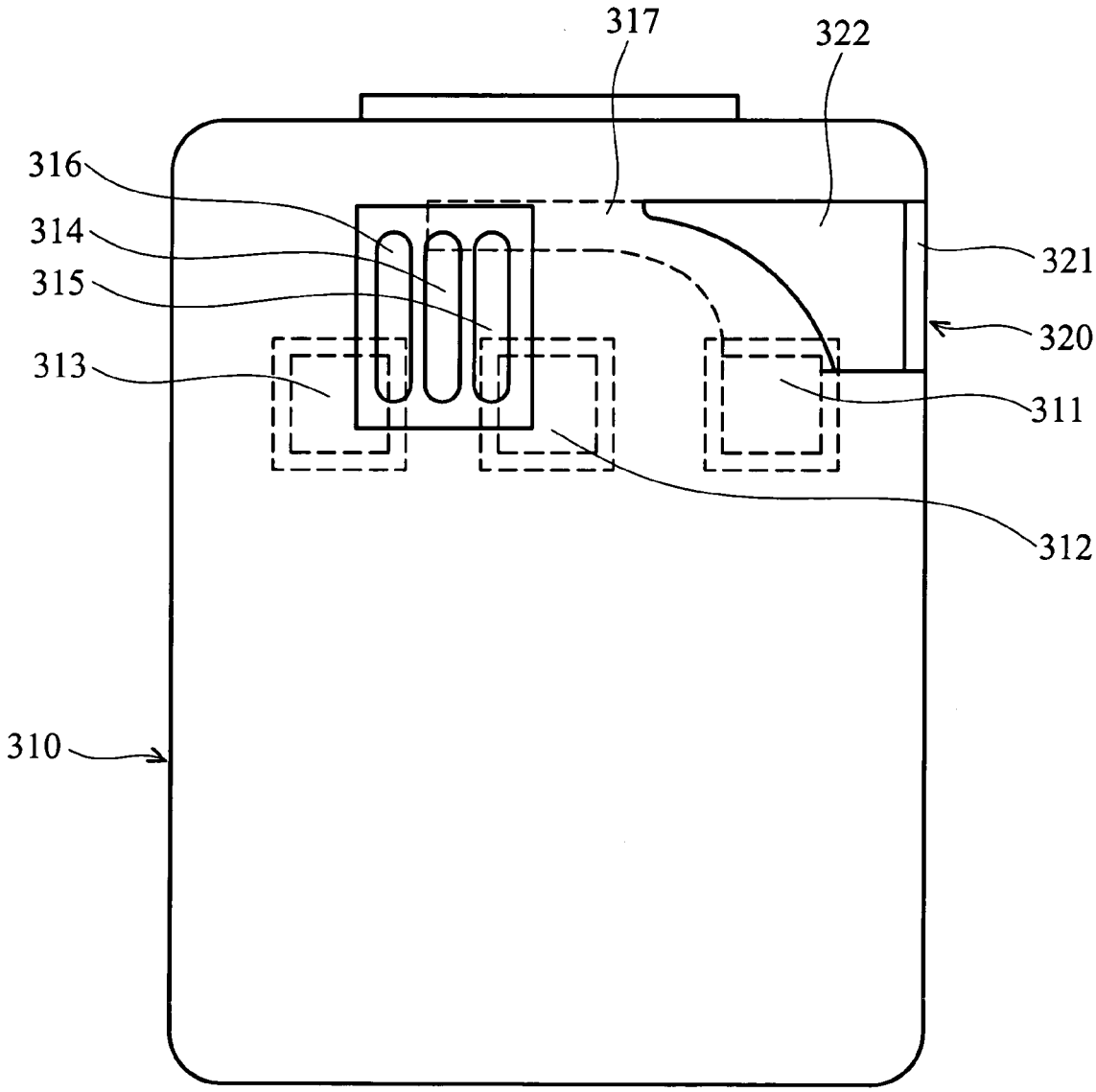
FIG. 3*c* is a top view of the inkjet cartridge in FIG. 3*a*, wherein a relationship between chambers and exits is shown.

Referring to FIG. 3*c*, the second chamber 312 communicates with the second exit 315 in a manner such that the second chamber 312 and the second exit 315 are overlapping in a plumb direction. Thus, the ink in the second chamber 312 can flow directly to the second exit 315. The third chamber 313 communicates with the third exit 316 in a manner such that the third chamber 313 and the third exit 316 are overlapping in a plumb direction. Thus, the ink in the third chamber 313 can flow directly to the third exit 316.

Figure 3D:
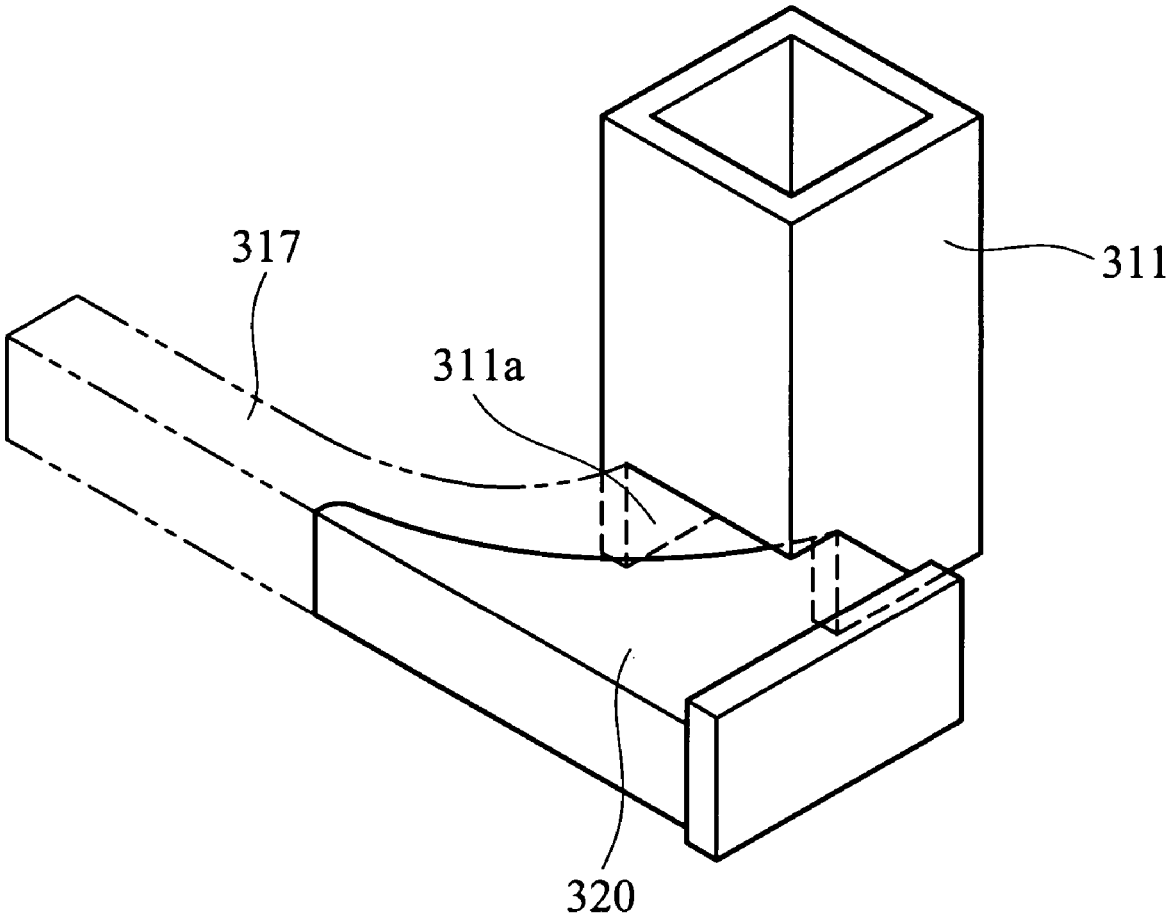
FIG. 3*d* is a schematic view showing a relationship among a second chamber, a seal member, and a channel.

Referring to FIG. 3*d*, the first chamber 311 is formed with a through hole 311*a* so that ink in the first chamber 311 flows to the channel 317.

In the inkjet cartridge 300 of this embodiment, the ink in two chambers 312, 313 can flow directly to two exits 315, 316 without flowing through additional channels. Thus, in the basic structure 700 of the invention, only one channel 317 is formed in the body 310. The channel 317 communicates the first chamber 311 and the first exit 314 so that the ink in the first chamber 311 can flow to the first exit 314 via the channel 317. That is, the first chamber 311 and the first exit 314 do not overlap in a plumb direction.

Additionally, since only one channel 317 is formed in the body 310 of the inkjet cartridge 300 of this embodiment, only one mold is inserted into one side of the body 310 during manufacture. That is, after the body 310 is integrally formed, only one opening 318 is formed in one side. It is noted that the hardness of a portion, adjacent to the opening 318, of the body 310 may be lower than the other portion of the body 310.

The seal member 320 is disposed on the channel 317 of the body 310 via the opening 318, and seals the channel 317 to prevent ink in the first chamber 311 flowing through the first exit 314 from flowing out of the opening 318. Thus, in the inkjet cartridge 300 of this embodiment, intermixture of ink in different chambers is prevented.

The seal member 320 includes a bottom portion 321 and an extended portion 322. The bottom portion 321 is closely disposed in the opening 318, and seals the opening 318. As shown in FIG. 3*c* and FIG. 3*d*, the extended portion 322 extends in the channel 317 and corresponds to the shape of the channel 317 so that the ink in the first chamber 311 can flow smoothly in the channel 317.

As shown in FIG. 3*d*, the through hole 311*a* of the first chamber 311 is abutted by the extended portion 322 of the seal member 320 so that the ink in the first chamber 311 can be guided into the channel 317.

It is understood that the seal member 320 may be made of the same material as the body 310.

The chip 330 actuates the dispensing of ink, and is disposed on the bottom surface of the body 310. The chip 330 includes a first hole 331, a second hole 332, and a third hole 333. The first hole 331 is located between the second hole 332 and the third hole 333. When the chip 330 is disposed on the bottom surface of the body 310, the first hole 331, the second hole 332, and the third hole 333 correspond to the first exit 314, the second exit 315, and the third exit 316 of the body 310 in order. That is, the first hole 331 of the chip 330 and the first chamber 311 of the body 310 do not overlap in a plumb direction.

The cover 340 is disposed on the top surface of the body 310, and seals the first inlet 311*b*, the second inlet 312*b*, and the third inlet 313*b*.

By means of the above structure, different kinds of ink flow in different passages respectively in the inkjet cartridge of this embodiment. Since only one channel is formed in the body when the body is integrally formed by injection molding, only one opening is sealed by one seal member. Thus, the channel can be completely sealed preventing intermixture of different kinds of ink. As a result, the printing quality of the inkjet cartridge of this embodiment can be maintained.

Additionally, in this embodiment, different kinds of ink flow independently through different passages, and the channel is completely sealed as only a single opening is sealed by a single seal member, thus simplifying inkjet cartridge assembly. Furthermore, only one kind of ink passes through one opening. When the opening is sealed, the intermixture will not occur due to manufacturing errors. Thus, the intermixture is prevented, and yield is increased.

Second Embodiment

Figure 4:
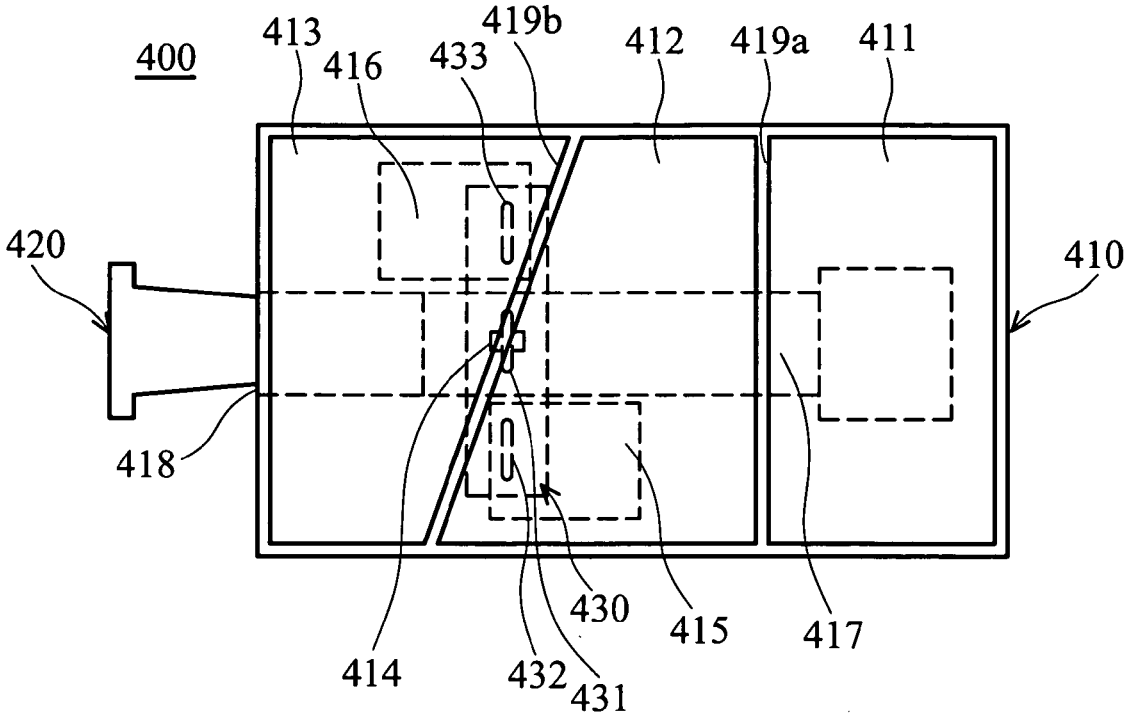
FIG. 4 is a top view of an inkjet cartridge as disclosed in a second embodiment of the invention.

FIG. 4 is a schematic view of an inkjet cartridge 400 as disclosed in a second embodiment of the invention. The inkjet cartridge 400 includes a body 410, a seal member 420, and a chip 430. It is understood that the description of structures in this embodiment same as those described in the first embodiment is omitted herein.

The body 410 is divided by inner walls into a first chamber 411, a second chamber 412, and a third chamber 413. The second chamber 412 is located between the first chamber 411 and the third chamber 413. That is, the first chamber 411, the second chamber 412, and the third chamber 413 are juxtaposed in the body 410. It is noted that a divider plate 419*b* between the second chamber 412 and the third chamber 413 is an inclined surface as shown in FIG. 4. That is, a divider plate 419*a* between the first chamber 411 and the second chamber 412 is not parallel with the divider plate 419*b*.

The body 410 includes a first exit 414, a second exit 415, and a third exit 416 in the bottom surface, and an opening 418 is formed in the side. A channel 417 is formed in the body 410.

Referring to FIG. 4, the second chamber 412 communicates with the second exit 415 in a manner such that the second chamber 412 and the second exit 415 are overlapping in a plumb direction. Thus, the ink in the second chamber 412 can flow directly to the second exit 415. The third chamber 413 communicates with the third exit 416 in a manner such that the third chamber 413 and the third exit 416 are overlapping in a plumb direction. Thus, the ink in the third chamber 413 can flow directly to the third exit 416.

In the inkjet cartridge 400 of this embodiment, the ink in two chambers 412, 413 can flow directly to two exits 415, 416 respectively without flowing through additional channels. Thus, in the inkjet cartridge 400 of this embodiment, only one channel 417 is formed in the body 410. The channel 417 communicates the first chamber 411 and the first exit 414 so that the ink in the first chamber 411 can flow to the first exit 414 via the channel 417. That is, the first chamber 411 and the first exit 414 do not overlap in a plumb direction.

Additionally, since only one channel 417 is formed in the body 410 of the inkjet cartridge 400 of this embodiment, only one mold is inserted in one side of the body 410 when the body 410 is manufactured. That is, after the body 410 is integrally formed, only one opening 418 is formed in one side.

The seal member 420 is disposed on the channel 417 of the body 410 via the opening 418, and seals the channel 418 to prevent ink in the first chamber 411 flowing through the first exit 414 from flowing out of the opening 418. Thus, in the inkjet cartridge 400 of this embodiment, intermixture of ink in different chambers is prevented.

The chip 430 is disposed on the bottom surface of the body 410, and includes a first hole 431, a second hole 432, and a third hole 433. The first hole 431 is located between the second hole 432 and the third hole 433. When the chip 430 is disposed on the bottom surface of the body 410, the first hole 431, the second hole 432, and the third hole 433 correspond to the first exit 414, the second exit 415, and the third exit 416 of the body 410 sequentially since the divider plate 419*b* has an inclined surface.

By means of the above structure, different kinds of ink flow in different passages respectively in the inkjet cartridge of this embodiment. Since only one channel is formed in the body when the body is integrally formed by injection molding, only a single opening is sealed by a single seal member. Thus, the channel can be completely sealed preventing intermixture of different kinds of ink. As a result, the printing quality of the inkjet cartridge of this embodiment can be maintained.

Additionally, in this embodiment, different kinds of ink flow independently through different passages, and the channel is completely sealed as only a single opening is sealed by a single seal member, thus simplifying inkjet cartridge assembly. Furthermore, only one kind of ink passes through one opening. When the opening is sealed, the intermixture will not occur due to manufacturing errors. Thus, the intermixture is prevented, and yield is increased.

Third Embodiment

Figure 5:
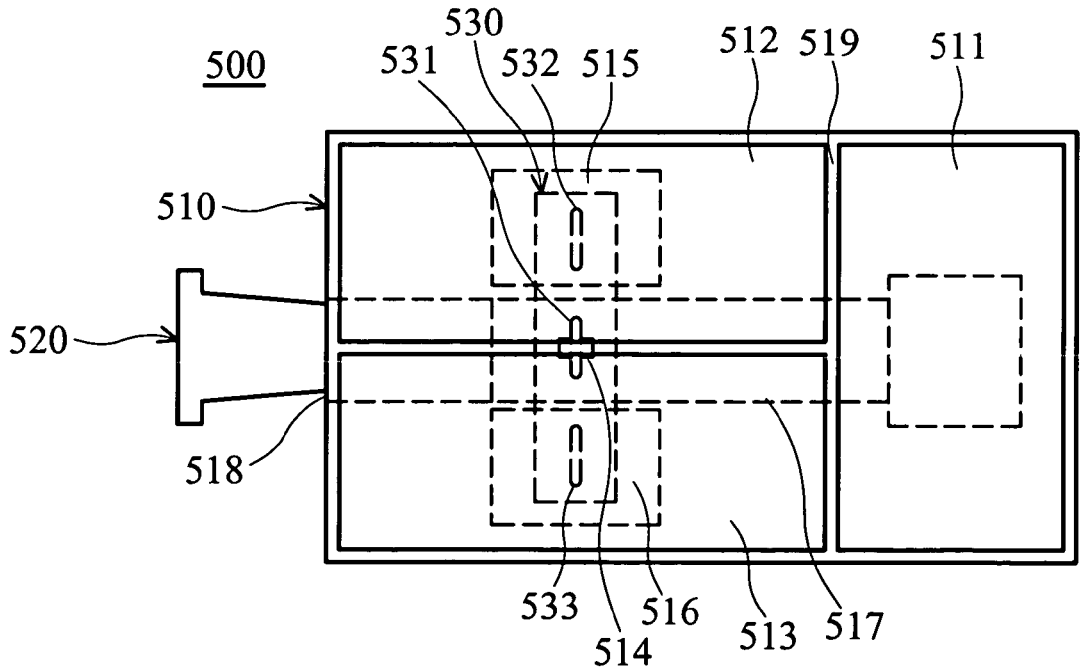
FIG. 5 is a top view of an inkjet cartridge as disclosed in a third embodiment of the invention.

FIG. 5 is a schematic view of an inkjet cartridge 500 as disclosed in a third embodiment of the invention. The inkjet cartridge 500 includes a body 510, a seal member 520, and a chip 530. It is understood that the description of structures in this embodiment same as those described in the first embodiment is omitted herein.

The body 510 is divided into a first chamber 511, a second chamber 512, and a third chamber 513 by its inner walls. The second chamber 512 and the third chamber 513 are juxtaposed in the body 510, and they are located on the same side of the first chamber 511. That is, the chambers 511, 512, 513 are adjacent to each other as shown in FIG. 5.

The body 510 includes a first exit 514, a second exit 515, and a third exit 516 in the bottom surface, and an opening 518 formed in the side. A channel 517 is formed in the body 510.

Referring to FIG. 5, the second chamber 512 communicates with the second exit 515 in a manner such that the second chamber 512 and the second exit 515 are overlapping in a plumb direction. Thus, the ink in the second chamber 512 can flow directly to the second exit 515. The third chamber 513 communicates with the third exit 516 in a manner such that the third chamber 513 and the third exit 516 are overlapping in a plumb direction. Thus, the ink in the third chamber 513 can flow directly to the third exit 516.

In the inkjet cartridge 500 of this embodiment, the ink in two chambers 512, 513 can flow directly to two exits 515, 516 respectively without flowing through additional channels. Thus, in the inkjet cartridge 500 of this embodiment, only one channel 517 is formed in the body 510. The channel 517 communicates the first chamber 511 and the first exit 514 so that the ink in the first chamber 511 can flow to the first exit 514 via the channel 517. That is, the first chamber 511 and the first exit 514 do not overlap in a plumb direction.

Additionally, since only one channel 517 is formed in the body 510 of the inkjet cartridge 500 of this embodiment, only one mold is inserted in one side of the body 510 when the body 510 is manufactured. That is, after the body 510 is integrally formed, only one opening 518 is formed in one side.

The seal member 520 is disposed on the channel 517 of the body 510 via the opening 518, and seals the channel 518 to prevent ink in the first chamber 511 flowing through the first exit 514 from flowing out of the opening 518. Thus, in the inkjet cartridge 500 of this embodiment, intermixture of ink in different chambers is prevented.

The chip 530 is disposed on the bottom surface of the body 510, and includes a first hole 531, a second hole 532, and a third hole 533. The first hole 531 is located between the second hole 532 and the third hole 533. When the chip 530 is disposed on the bottom surface of the body 510, the first hole 531, the second hole 532, and the third hole 533 correspond to the first exit 514, the second exit 515, and the third exit 516 of the body 510 in order. That is, the first hole 531 of the chip 530 and the first chamber 511 of the body 510 are not overlapping in a plumb direction.

Furthermore, the first hole 531, the second hole 532, and the third hole 533 are aligned in a straight line as shown in FIG. 5, and the straight line is substantially parallel with a divider plate 519 between the first chamber 511 and the second chamber 512.

By means of the above structure, different kinds of ink flow in different passages respectively in the inkjet cartridge of this embodiment. Since only one channel is formed in the body when the body is integrally formed by injection molding, only a single opening is sealed by a single seal member. Thus, the channel can be completely sealed preventing intermixture of different kinds of ink. As a result, the printing quality of the inkjet cartridge of this embodiment can be maintained.

Figure 6:
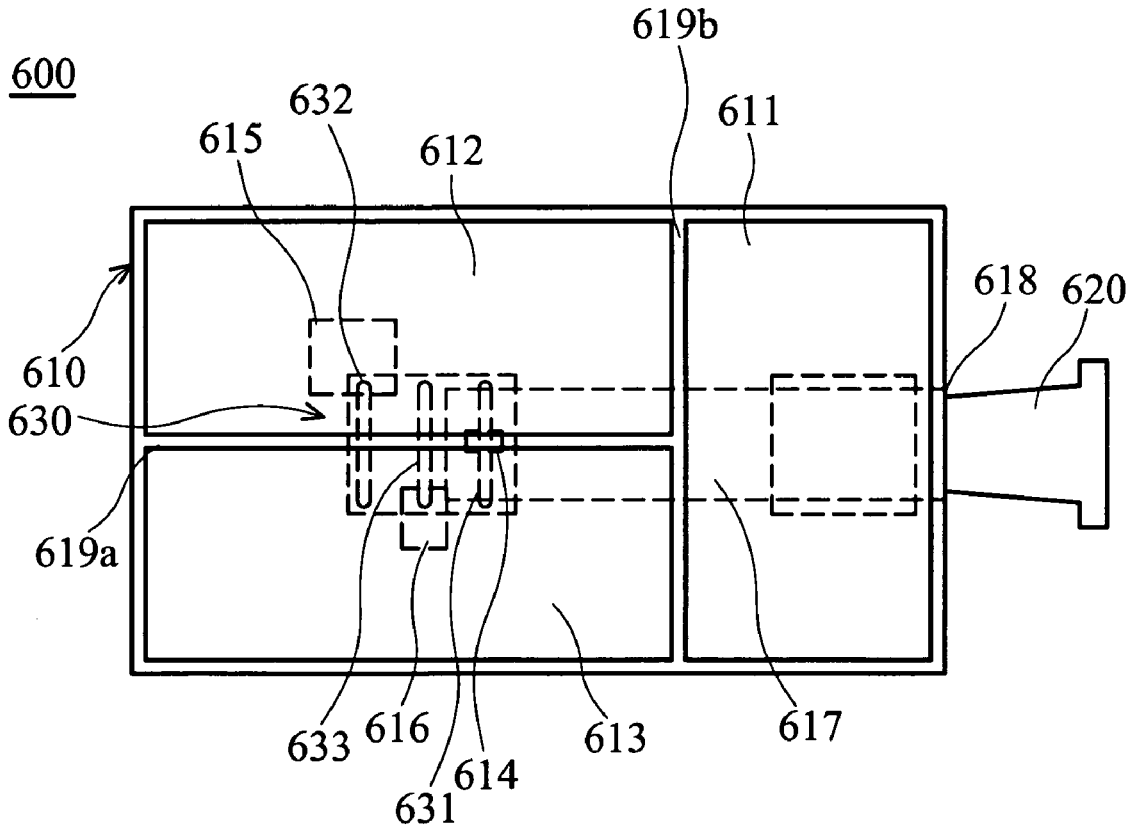
FIG. 6 is a top view of an inkjet cartridge as disclosed in a fourth embodiment of the invention.

Additionally, in this embodiment, different kinds of ink flow independently through different passages, and the channel is completely sealed as only a single opening is sealed by a single seal member, thus simplifying inkjet cartridge assembly. Furthermore, only one kind of ink passes through one opening. When the opening is sealed, the intermixture will not occur due to manufacturing errors. Thus, the intermixture is prevented, and yield is increased Fourth Embodiment FIG. 6 is a schematic view of an inkjet cartridge 600 as disclosed in a fourth embodiment of the invention. The inkjet cartridge 600 includes a body 610, a seal member 620, and a chip 630. It is understood that the description of structures in this embodiment same as those described in the first embodiment is omitted herein.

The body 610 is divided by inner walls into a first chamber 611, a second chamber 612, and a third chamber 613. The second chamber 612 and the third chamber 613 are disposed in the body 610, and they are located on the same side of the first chamber 611. That is, the chambers 611, 612, 613 are adjacent to each other as shown in FIG. 6.

The body 610 includes a first exit 614, a second exit 615, and a third exit 616 in the bottom surface, and an opening 618 formed in the side. A channel 617 is formed in the body 610.

Referring to FIG. 6, the second chamber 612 communicates with the second exit 615 in a manner such that the second chamber 612 and the second exit 615 are overlapping in a plumb direction. Thus, the ink in the second chamber 612 can flow directly to the second exit 615. The third chamber 613 communicates with the third exit 616 in a manner such that the third chamber 613 and the third exit 616 are overlapping in a plumb direction. Thus, the ink in the third chamber 613 can flow directly to the third exit 616.

In the inkjet cartridge 600 of this embodiment, the ink in two chambers 612, 613 can flow directly to two exits 615, 616 respectively without flowing through additional channels. Thus, in the inkjet cartridge 600 of this embodiment, only one channel 617 is formed in the body 610. The channel 617 communicates the first chamber 611 and the first exit 614 so that the ink in the first chamber 611 flow to the first exit 614 via the channel 617. That is, the first chamber 611 and the first exit 614 do not overlap in a plumb direction.

Additionally, since only one channel 617 is formed in the body 610 of the inkjet cartridge 600 of this embodiment, only one mold is inserted in one side of the body 610 when the body 610 is manufactured. That is, after the body 610 is integrally formed, only one opening 618 is formed in one side.

The seal member 620 is disposed on the channel 617 of the body 610 via the opening 618, and seals the channel 618 to prevent ink in the first chamber 611 flowing through the first exit 614 from flowing out of the opening 618. Thus, in the inkjet cartridge 600 of this embodiment, only one channel 617 is sealed by one seal member 620, intermixture of ink in different chambers is prevented.

The chip 630 is disposed on the bottom surface of the body 610, and includes a first hole 631, a second hole 632, and a third hole 633. The third hole 633 is located between the first hole 631 and the second hole 632. It is noted that the type of the chip of this embodiment is different from that of the third embodiment. That is, the holes 631, 632, 633 are parallel with each other, unlike the third embodiment. When the chip 630 is disposed on the bottom surface of the body 610, the first hole 631, the second hole 632, and the third hole 633 correspond to the first exit 614, the second exit 615, and the third exit 616 of the body 610 in order. That is, the first hole 631 of the chip 630 and the first chamber 611 of the body 610 are not overlapping in a plumb direction.

Furthermore, the first hole 631, the second hole 632, the third hole 633 are aligned in a straight line as shown in FIG. 6, and the straight line is substantially parallel with a divider plate 619*a* between the second chamber 612 and the third chamber 613. The first hole 631 is closer to a divider plate 619*b* between the first chamber 611 and the second chamber 612 than the second hole 632.

By means of the above structure, different kinds of ink flow in different passages respectively in the inkjet cartridge of this embodiment. Since only one channel is formed in the body when the body is integrally formed by injection molding, only a single opening is sealed by a single seal member. Thus, the channel can be completely sealed preventing intermixture of different kinds of ink. As a result, the printing quality of the inkjet cartridge of this embodiment can be maintained.

Additionally, in this embodiment, different kinds of ink flow independently through different passages, and the channel is completely sealed as only a single opening is sealed by a single seal member, thus simplifying inkjet cartridge assembly. Furthermore, only one kind of ink passes through one opening. When the opening is sealed, the intermixture will not occur due to manufacturing errors. Thus, the intermixture is prevented, and yield is increased While the invention has been described by way of example and in terms of the preferred embodiments, it is to be understood that the invention is not limited to the disclosed embodiments. To the contrary, it is intended to flipper various modifications and similar arrangements (as would be apparent to those skilled in the art). Therefore, the scope of the appended claims should be accorded the broadest interpretation so as to encompass all such modifications and similar arrangements.

What is claimed is:

1. An inkjet cartridge comprising:

a body including a first chamber, a second chamber, a third chamber, a first exit, a second exit, a third exit, an opening, and a channel, wherein ink is received in the first chamber, the second chamber, and the third chamber respectively, the second chamber communicates with the second exit so that the ink in the second chamber flow directly to the second exit, the third chamber communicates with the third exit so that the ink in the third chamber flow directly to the third exit, and the channel communicates the first chamber and the first exit so that the ink in the first chamber flows to the first exit via the channel; and a seal member, disposed on the channel via the opening, for sealing the channel and preventing the ink in the first chamber flowing through the first exit from flowing out of the opening.

2. The inkjet cartridge as claimed is claim 1, further comprising:

a chip including a first hole, a second hole, and a third hole, wherein the chip is disposed on the body in a manner such that the first hole, the second hole, and the third hole correspond to one of the first exit, the second exit, and the third exit respectively.

3. The inkjet cartridge as claimed in claim 2, wherein the first hole is located between the second hole and the third hole, the second hole and the second exit are overlapping, and the third hole and the third exit are overlapping.

4. The inkjet cartridge as claimed in claim 3, further comprising:

a first divider plate for separating the first chamber and the second chamber, wherein the first hole, the second hole, and the third hole are aligned in a straight line, the straight line is substantially parallel with the first divider plate.

5. The inkjet cartridge as claimed in claim 2, wherein the third hole is located between the first hole and the second hole, the second hole and the second exit are overlapping, and the third hole and the third exit are overlapping.

6. The inkjet cartridge as claimed in claim 5, further comprising:

a second divider plate for separating the second chamber and the third chamber; and a third divider plate for separating the first chamber and the second chamber.

7. The inkjet cartridge as claimed in claim 6, wherein the first hole, the second hole, and the third hole are aligned in a straight line, the straight line is substantially parallel with the second divider plate, and the first hole is closer to the third divider plate than the second hole.

8. The inkiet cartridge as claimed in claim 2, wherein the first hole and the first chamber do not overlap.

9. The inkjet cartridge as claimed in claim 1, wherein the second chamber is located between the first chamber and the third chamber, and the first exit is located between the second exit and the third exit.

10. The inkjet cartridge as claimed in claim 1, wherein the second exit and the second chamber are overlapping, and the third exit and the third chamber are overlapping.

11. The inkjet cartridge as claimed in claim 1, wherein the first chamber and the first exit do not overlap.

12. The inkjet cartridge as claimed in claim 1, wherein the first chamber, the second chamber, and the third chamber are adjacent to each other.

13. The inkjet cartridge as claimed in claim 12, wherein the second chamber and the third chamber are located on the same side of the first chamber.

14. The inkjet cartridge as claimed in claim 1, wherein the seal member is made of the same material as the body.

15. The inkjet cartridge as claimed in claim 1, wherein the hardness of a portion, adjacent to the opening, of the body is lower than the other portion of the body.

16. The inkjet cartridge as claimed in claim 1, wherein the first chamber, the second chamber, and the third chamber are juxtaposed in the body.

17. The inkjet cartridge as claimed in claim 1, wherein the seal member comprises:

a bottom portion, closely disposed on the opening, for sealing the opening; and an extended portion extending in the channel and corresponding to the shape of the channel so that the ink in the first chamber flows smoothly in the channel.

18. The inkjet cartridge as claimed in claim 17, wherein the first chamber includes a through hole abutted by the extended portion of the seal member.

19. The inkjet cartridge as claimed in claim 1, wherein the first chamber, the second chamber, the third chamber include a first inlet, a second inlet, a third inlet respectively, the ink flows into the first chamber, the second chamber, the third chamber through the first inlet, the second inlet, the third inlet respectively, and the inkjet cartridge further includes a cover for sealing the first inlet, the second inlet, and the third inlet.

20. The inkjet cartridge as claimed in claim 1, further comprising:

a fourth divider plate for separating the first chamber and the second chamber; and a fifth divider plate for separating the second chamber and the third chamber, wherein the fourth divider plate is not parallel with the fifth divider plate.

21. A structure for an inkjet cartridge with a plurality of partitions, comprising:

an integrally formed body including a first chamber, a second chamber, a third chamber, a first exit, a second exit, a third exit, an opening, and a channel, wherein ink is received in the first chamber, the second chamber, and the third chamber respectively, the second chamber communicates with the second exit so that the ink in the second chamber flow directly to the second exit, the third chamber communicates with the third exit so that the ink in the third chamber flow directly to the third exit, the channel communicates the first chamber and the first exit so that the ink in the first chamber flows to the first exit via the channel, and the body and the channel are a unitary member.

22. The structure as claimed in claim 21, wherein the second chamber is located between the first chamber and the third chamber, and the first exit is located between the second exit and the third exit.

23. The structure as claimed in claim 21, wherein the second exit and the second chamber are overlapping, and the third exit and the third chamber are overlapping.

24. The structure as claimed in claim 21, wherein the first chamber and the first exit do not overlap.

25. The structure as claimed in claim 21, wherein the first chamber, the second chamber, and the third chamber are adjacent to each other.

26. The structure as claimed in claim 25, wherein the second chamber and the third chamber are located on the same side of the first chamber.

27. The structure as claimed in claim 21, wherein the hardness of a portion, adjacent to the opening, of the body is lower than the other portion of the body.

28. The structure as claimed in claim 21, wherein the first chamber, the second chamber, and the third chamber are juxtaposed in the body.

29. The structure as claimed in claim 21, wherein the first chamber, the second chamber, the third chamber include a first inlet, a second inlet, a third inlet respectively, the ink flows into the first chamber, the second chamber, the third chamber through the first inlet, the second inlet, the third inlet respectively.

30. The inkjet cartridge as claimed in claim 21, further comprising:

a chip including a first hole, a second hole, and a third hole; and a first divider plate for separating the first chamber and the second chamber, wherein the first hole, the second hole, and the third hole are aligned in a straight line, the straight line is substantially parallel with the first divider plate.

31. The inkjet cartridge as claimed in claim 21, further comprising a chip including a first hole, a second hole, and a third hole; wherein the third hole is located between the first hole and the second hole, the second hole and the second exit are overlapping, and the third hole and the third exit are overlapping.

32. The inkjet cartridge as claimed in claim 31, further comprising:

a second divider plate for separating the second chamber and the third chamber; and a third divider plate for separating the first chamber and the second chamber.

33. The inkjet cartridge as claimed in claim 32, wherein the first hole, the second hole, and the third hole are aligned in a straight line, the straight line is substantially parallel with the second divider plate, and the first hole is closer to the third divider plate than the second hole.

* * * * *